US007970324B2

(12) United States Patent
Hori et al.

(10) Patent No.: US 7,970,324 B2
(45) Date of Patent: Jun. 28, 2011

(54) DEVELOPING DEVICE, PROCESS CARTRIDGE, AND IMAGE FORMING APPARATUS FOR PREVENTING AN ABNORMAL IMAGE DUE TO ABNORMAL FLUIDITY OF A DEVELOPER

(75) Inventors: Eisuke Hori, Tokyo (JP); Hideki Kimura, Kanagawa (JP); Kenji Kikuchi, Kanagawa (JP); Takafumi Kondo, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 37 days.

(21) Appl. No.: 12/480,296

(22) Filed: Jun. 8, 2009

(65) Prior Publication Data

US 2010/0003058 A1 Jan. 7, 2010

(30) Foreign Application Priority Data

Jul. 2, 2008 (JP) ..... 2008-173800
Mar. 10, 2009 (JP) ..... 2009-056634

(51) Int. Cl.
*G03G 15/08* (2006.01)

(52) U.S. Cl. ..... 399/284

(58) Field of Classification Search ..... 399/119, 399/252–254, 284
See application file for complete search history.

(56) References Cited

U.S. PATENT DOCUMENTS

| | | | | |
|---|---|---|---|---|
| 6,826,381 | B2 | 11/2004 | Muramatsu et al. | |
| 6,859,633 | B2 * | 2/2005 | Handa et al. | 399/119 |
| 7,043,182 | B2 | 5/2006 | Sakai et al. | |
| 7,212,773 | B2 | 5/2007 | Sudo et al | |
| 7,228,093 | B2 | 6/2007 | Sakai et al. | |
| 7,272,342 | B2 | 9/2007 | Nagashima et al. | |
| 7,457,570 | B2 | 11/2008 | Kasai et al. | |
| 2005/0031374 | A1 | 2/2005 | Nagashima et al. | |
| 2007/0104516 | A1 | 5/2007 | Katoh et al. | |
| 2008/0013982 | A1 | 1/2008 | Kimura | |
| 2008/0063439 | A1 | 3/2008 | Kondo et al. | |
| 2008/0205937 | A1 | 8/2008 | Hori et al. | |
| 2009/0022504 | A1 | 1/2009 | Kuwabara et al. | |
| 2009/0047036 | A1 | 2/2009 | Hori et al. | |

FOREIGN PATENT DOCUMENTS

| | | |
|---|---|---|
| JP | 7-117267 | 5/1995 |
| JP | 3320954 | 6/2002 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A developer carrier is provided in a rotatable manner. A layer-thickness control member makes a layer thickness of a developer carried on the developer carrier uniform. An accelerated agglomeration degree of the developer is equal to or less than 40%. The layer-thickness control member is formed with a blade. An angle between a rolling direction of the blade and a rotating direction of the developer carrier is set to 5 degrees to 80 degrees.

11 Claims, 4 Drawing Sheets

DEVELOPING DEVICE, PROCESS CARTRIDGE, AND IMAGE FORMING APPARATUS FOR PREVENTING AN ABNORMAL IMAGE DUE TO ABNORMAL FLUIDITY OF A DEVELOPER

CROSS-REFERENCE TO RELATED APPLICATIONS

The present application claims priority to and incorporates by reference the entire contents of Japanese priority document 2008-173800 filed in Japan on Jul. 2, 2008 and Japanese priority document 2009-056634 filed in Japan on Mar. 10, 2009.

BACKGROUND OF THE INVENTION

1. Field of the Invention

The present invention relates to a technology for preventing an abnormal image due to abnormal fluidity of a developer.

2. Description of the Related Art

In image forming apparatuses such as copiers, facsimiles, printers, or printing machines, an image visualizing process is performed on an electrostatic latent image carried on a photosensitive element, which is a latent-image carrier, using a one-component developer or a two-component developer.

Some of developing devices are configured to carry the one-component developer using nonmagnetic toner or magnetic toner contained in a container by a developer feed member made of foamed polyurethane, and to feed the developer to a developing sleeve used for the image visualizing process.

Japanese Patent No. 3320954 discloses an invention in which a developer carried on a developing sleeve is controlled such that a layer thickness of the developer carried thereon is made uniform by a layer-thickness control member, which is an elastic metal thin plate, before the developer reaches a position opposed to a photosensitive element.

The image visualizing process is roughly divided into a two-component developing method and a one-component developing method depending on how toner is charged. The two-component developing method uses frictional charge due to stirring and mixing of toner and carrier, and the one-component developing method uses application of charge to toner without using carrier. The one-component developing method is further divided into a magnetic one-component developing method and a non-magnetic one-component developing method according to whether a magnetic force is used for retention of toner on a developing roller.

Up to now, the two-component developing method is used in many copiers or copier-based multifunction products of which high-speed performance and high image reproducibility are demanded, because of requirements such as toner charge stability, good charge rising property, and long-term stability of image quality. Meanwhile, the one-component developing method is used in many compact printers and facsimile devices of which space saving and cost reduction are demanded.

In either developing method, colorization of output images is advancing in recent years, and thus, requests for higher image quality and stability of image quality are increasing today more than ever.

To achieve such higher image quality, an average particle size of toner is decreased, and square portions of toner particles quite often tend to be smoothed. Because of this, the toner is becoming more spherical.

In the developing device, however, as explained above, the layer-thickness control member controls the layer thickness of the toner carried on the developing sleeve, but small-sized toner and more spherical toner may sometimes easily slip under an edge of the layer-thickness control member.

As disclosed in Japanese Patent No. 3320954, of the toner whose thickness on the developing sleeve is controlled, some of toner particles that are not consumed for the image visualizing process are collected into a developer tank using a collecting member, are again stirred therein so as to increase a charge amount to a predetermined amount, and are again fed to the developing sleeve.

Therefore, the toner particles carried on the developing sleeve repeatedly slip under the layer-thickness control member. However, slidable friction due to repetition of the slipping may sometimes cause particles as a fluidization promoter being an external additive of the toner to be scraped off, or shape deformation of the toner particles due to the same factor may sometimes cause their original functions to be increasingly degraded.

Reasons for the cases can be considered as follows.

Of the toner particles having reached a position of the layer-thickness control member, some toner particles having a height of a toner chain that exceeds the layer thickness controlled by the layer-thickness control member collide against the layer-thickness control member. The collision may cause the shapes of the toner particles to be deformed or to be partially chipped, which makes it impossible to obtain a charge amount such that the charge amount is supposed to be obtained based on regularly shaped toner particles.

Further, the same goes for a case in which the toner particles undergo high frictional force due to scraping force received from the collecting member when the toner particles are collected from the developing sleeve.

As explained above, the degradation of the toner particles such as the shape deformation and the partial chipping causes encapsulated additives and waxes to be exposed. At this state, a predetermined charge amount cannot be obtained because the condition of charging the surface of toner is changed.

When the toner particles are degraded, especially, the particles as the fluidization promoter are removed from toner particles, fluidity of the toner particles is degraded, which causes the degraded toner particles to accumulate on and to be condensed on the surface of the layer-thickness control member. Consequently, the condensed toner particles adhere on the surface thereof. This case leads to production of a portion in which the toner particles do not adhere on the surface thereof and of a portion in which the toner particles adhere thereon. As a result, the distribution of the layer thickness controlled by the layer-thickness control member varies depending on the portions, and thus, the layer thickness cannot be controlled to a uniform one.

A blade is used as the layer-thickness control member, and streaks and dents are produced on a surface of the blade, in particular, at a process of rolling the blade, and further scratches or irregularities are sometimes produced thereon. If these irregularities are produced, toner particles may easily enter the streaks or the like at the same position as the irregularities in a width direction of the layer-thickness control member. Therefore, this state is continued, and the toner particles are eventually condensed to adhere on the portion.

If the toner partially adheres on the layer-thickness control member in the width direction, a portion on which the toner adheres may be different from normal layer-thickness control dimensions. This causes the width direction of the layer-thickness control member, or the distribution of the layer thickness in an axial direction of the developing sleeve, to be made nonuniform.

Therefore, Japanese Patent Application Laid-open No. H07-117267 proposes a method of eliminating scratches and irregularities on which toner particles tend to be accumulated by polishing the surface of a blade used as the layer-thickness control member.

The case in which the surface of the blade is polished to eliminate the scratches and the irregularities causes processing cost to be increased, because one process is increased in the manufacturing process that results in two processes, as compared with a case in which secondary processing such as polishing is not performed.

A factor why the toner particles are easily accumulated in the irregularities produced on the surface of the blade is caused by not only the blade itself but also the toner itself that easily moves. Specifically, it is also considered that an accelerated agglomeration degree of toner that affects mobility of the toner is also caused to slip the toner particles through a nip portion between the blade and the developing sleeve.

If the accelerated agglomeration degree of toner is higher, the toner is more difficult to move, while if the accelerated agglomeration degree of toner is lower, then the toner more easily moves. Therefore, when the accelerated agglomeration degree of toner is low, the toner easily enters into a narrow portion, and also easily passes through the nip portion with the blade. This causes the slipping to be easily repeated, which causes degradation of the toner to easily occur.

SUMMARY OF THE INVENTION

It is an object of the present invention to at least partially solve the problems in the conventional technology.

According to one aspect of the present invention, there is provided a developing device including a developer carrier provided in a rotatable manner; and a layer-thickness control member that makes a layer thickness of a developer carried on the developer carrier uniform. An accelerated agglomeration degree of the developer is equal to or less than 40%. The layer-thickness control member is formed with a blade. An angle between a rolling direction of the blade and a rotating direction of the developer carrier is set to 5 degrees to 80 degrees.

Furthermore, according to another aspect of the present invention, there is provided a process cartridge including a developing device and an image carrier. The developing device includes a developer carrier provided in a rotatable manner, and a layer-thickness control member that makes a layer thickness of a developer carried on the developer carrier uniform. The image carrier carries an electrostatic latent image to be developed by the developing device. An accelerated agglomeration degree of the developer is equal to or less than 40%. The layer-thickness control member is formed with a blade. An angle between a rolling direction of the blade and a rotating direction of the developer carrier is set to 5 degrees to 80 degrees.

Moreover, according to still another aspect of the present invention, there is provided an image forming apparatus including a process cartridge that includes a developing device and an image carrier. The developing device includes a developer carrier provided in a rotatable manner, and a layer-thickness control member that makes a layer thickness of a developer carried on the developer carrier uniform. The image carrier carries an electrostatic latent image to be developed by the developing device. An accelerated agglomeration degree of the developer is equal to or less than 40%. The layer-thickness control member is formed with a blade. An angle between a rolling direction of the blade and a rotating direction of the developer carrier is set to 5 degrees to 80 degrees.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
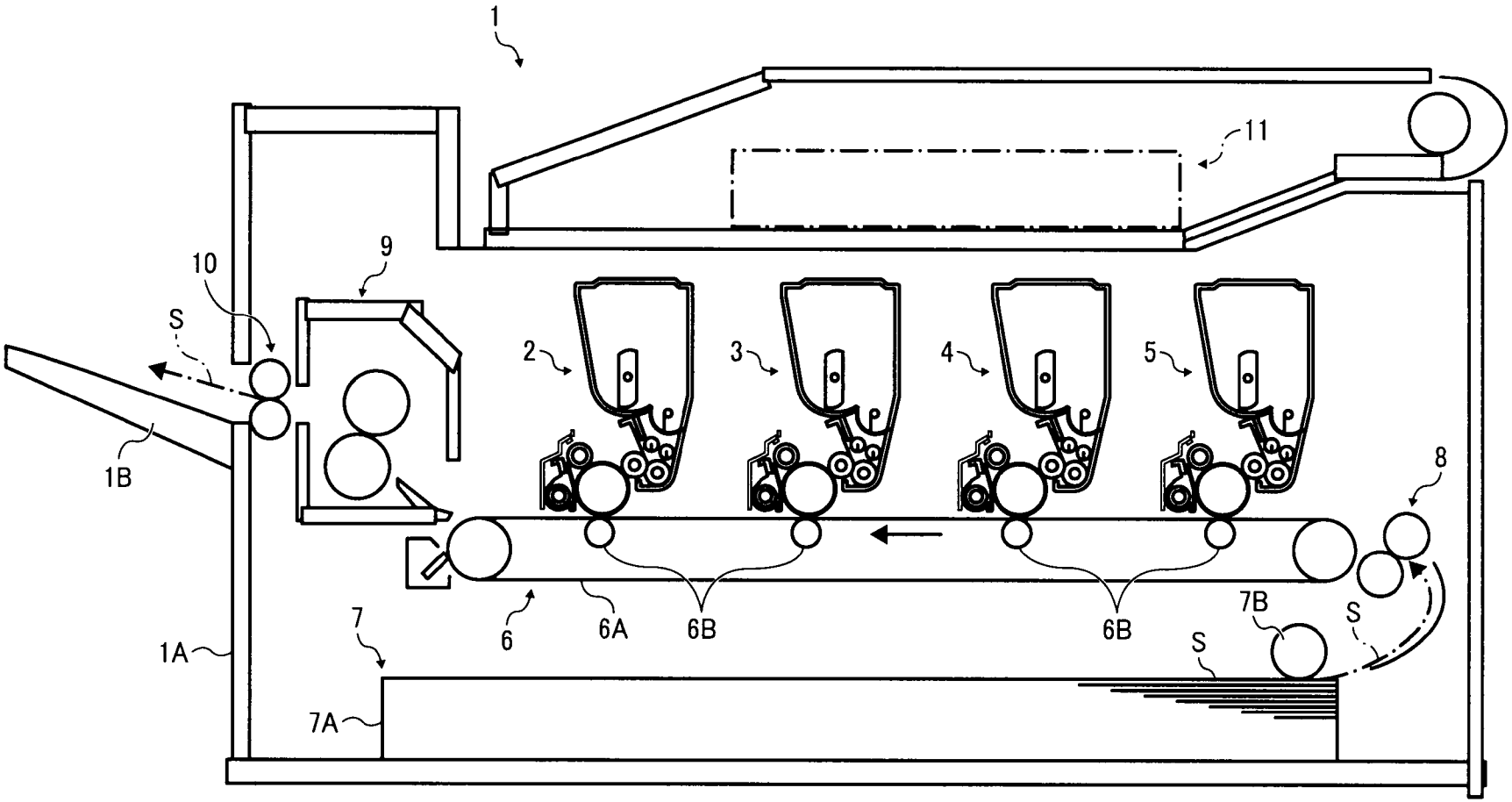
FIG. 1 is a schematic diagram of an image forming apparatus using a developing device according to the present invention.

Exemplary embodiments of the present invention are explained in detail below with reference to the accompanying drawings.

First, a developer used in a developing device according to the present invention is explained below. The developer that satisfies the following conditions is used as toner.

Toner used in the developing device has high fluidity. Specifically, the toner to be used has an accelerated agglomeration degree of 40% or less. The accelerated agglomeration degree in this case represents an index indicating fluidity of toner.

The accelerated agglomeration degree of toner is checked using a following method.

Measurement device:

Powder Tester manufactured by Hosokawa Micron Corp.

Measurement method:

Sample to be measured is left out in a temperature-controlled bath (35±2° C., 24±1 hours)

Measurement using Powder Tester:

Three types of sieves with different openings thereof are used (e.g., 75 micrometers, 44 micrometers, and 22 micrometers).

The agglomeration degree is determined by being calculated from a residual amount of toner particles when they are sifted using following computations:

((weight of powder remaining in an upper sieve)/(collected amount of sample))×100, ((weight of powder remaining in a middle sieve)/(collected amount of sample))×100×3/5, and ((weight of powder remaining in a bottom sieve)/(collected amount of sample))×100×1/5.

A total of the three computational values is determined as a thermal agglomeration degree (%) of toner.

The thermal agglomeration degree of toner is an index determined in such a manner that the three types of sieves with different mesh-openings are stacked in order from a sieve with a largest mesh-opening, and particles are put in the topmost sieve and are sifted with predetermined vibrations, to determine the agglomeration degree from the weights of powder on the respective sieves.

Here, an accelerated agglomeration degree of toner according to an embodiment of the present invention is explained.

As explained above, the accelerated agglomeration degree of toner is an element to affect the fluidity of toner, which has characteristics such that if the accelerated agglomeration degree of toner is higher, then the toner is more difficult to move, while if the accelerated agglomeration degree of toner is lower, then the toner more easily moves.

Therefore, the lower the accelerated agglomeration degree of toner is, the more easily the toner enters into a narrow portion, which causes the toner to pass through the nip portion with the blade. Consequently, as explained above, the toner slipping is repeated, which causes the slidable friction to be produced upon the repetition, and the toner is thereby easily degraded.

Meanwhile, as explained above, it is also considered that the degradation of the toner is caused by removal of the external additives, from the toner, used as the fluidization promoter, and that the removal of the external additives causes fluidization of the toner to be worsened and the toner to become more difficult to move.

The removal of the external additives from the toner affecting the fluidity results in a change in the condition of charging the surface of the toner, which may cause a decrease in the charge amount.

Therefore, in the embodiment, experiments on the agglomeration degree of toner were conducted, to obtain experimental results as shown in Table 1 (explained later).

When the accelerated agglomeration degree of toner is 43% (indicated by toner D in Table 1), an obtained result is such that adhesion of toner to the blade does not occur, which is one of achievements of the present invention. When the accelerated agglomeration degree of toner is 36% (indicated by toner A in Table 1), an obtained result is such that the adhesion of toner occurs. As explained above, it becomes clear that whether the adhesion of toner occurs significantly depends on whether the accelerated agglomeration degree of toner exceeds 40%.

Furthermore, when the accelerated agglomeration degree of toner is high, for example, in the case of the toner D in Table 1, because the accelerated agglomeration degree of toner is high from the beginning, the fluidity i.e. movement of the toner is thereby low, and thus even if a nip pressure of the blade tends to be set to a comparatively low value, the toner amount passing through the nip portion under the condition is difficult to change, and the toner is thereby difficult to be degraded and also hardly adheres to the blade.

Meanwhile, conversely to the above case, when the accelerated agglomeration degree of toner is low, for example, in the case of the toner A in Table 1, because the fluidity of new toner is high or the new toner easily moves, the nip pressure of the blade tends to be set to a comparatively high value (strong), and a result obtained from this is such that mobility of the toner changes for the worse which causes the adhesion to begin under the condition. Thus, a relationship between the agglomeration degree of toner and a cleaning nip pressure may also affect the adhesion of the toner.

From the results, as explained above, the accelerated agglomeration degree of toner is set to 40% or less in the present invention.

Next, the toner particles with an average circularity of 0.93 to 1.00 are used. The average circularity is an average of circularities SR expressed by the following Equation (1).

$$\text{Circularity } SR = (\text{circumferential length of a circle having an area equivalent to a projected area of a toner particle})/(\text{circumferential length of a projected image of the toner particle}) \quad (1)$$

If the average circularity is in a range of 0.93 to 1.00, then respective surfaces of the toner particles are smooth, and each contact area between the toner particles and between each toner particle and a photosensitive element is small, which allows excellent transfer performance. Moreover, the toner particles have no angular portions, and mixing torque of the developer in the developing device is small and mixing is stably driven, which does not cause defective images. In addition, because there are no angular toner particles in the toner particles to form dots, when the toner particles are press-contacted with a recording medium upon transfer, the pressure is evenly applied to all the toner particles forming dots, and voids due to improper transfer thereby hardly occur. Moreover, because the toner particles are not angular-shaped, grinding force thereof is small, and thus, the toner particles do not cause to damage the surface of an image carrier and to wear the surface thereof.

The circularity SR can be measured by using, for example, Particle Analyzer FPIA-1000 (manufactured by Toa Medical Electronics).

First, water of 100 milliliters to 150 milliliters from which impurity solid is previously removed is put into a container, a surfactant (preferably, alkylbenzene sulfonic acid) being a dispersing agent is added by 0.1 milliliter to 0.5 milliliter to the water, and sample to be measured is further added thereto by about 0.1 gram to 0.5 gram. A suspension with the sample dispersed therein is dispersed for about 1 minute to 3 minutes by an ultrasonic disperser, and concentration of a dispersing solution is controlled to 3,000 to 10,000 pieces/μl, and each shape and particle size of toner particles are thereby measured.

To reproduce fine dots of 600 dots per inch (dpi) or more and to achieve prevention of toner adhesion to the layer-thickness control member, a favorable result is obtained when a volume-average particle size (D4) of toner particles is set to 3 micrometers to 8 micrometers.

This range includes toner particles with a sufficiently small particle size with respect to fine latent-image dots, which allows excellent dot reproducibility. If the volume-average particle size (D4) is less than 3 micrometers, then phenomena such as decrease in transfer efficiency and decrease in blade-cleaning performance may easily occur. If it exceeds 8 micrometers, then it may be difficult to prevent scattering of toner particles to form a character and a line.

A ratio (D4/D1) of the weight-average particle size (D4) to a number-average particle size (D1) of toner particles is preferably 1.00 to 1.40, and more preferably 1.00 to 1.30. A particle-size distribution of the toner particles is sharper as the ratio (D4/D1) approaches 1. The toner particles with such a small particle size and a narrow particle-size distribution allow a uniform charge distribution, so that a high quality image with decreased background fogging can be obtained. Moreover, a uniform toner particle size allows latent-image dots to be developed so that toner particles are finely and regularly arranged thereon. Therefore, the uniform toner particle size is excellent in dot reproducibility and is also capable of increasing a transfer rate when an electrostatic transfer system is used.

The weight-average particle size (D4) and the particle-size distribution of toner particles are measured by using a Coulter Counter method.

A measurement device of the particle-size distribution of toner particles using the Coulter Counter method includes Coulter Counter TA-II and Coulter Multisizer II (both are made by Coulter Co.).

First, a surfactant (preferably, alkylbenzene sulfonic acid) being a dispersing agent is added by 0.1 milliliter to 5 milliliters to an electrolytic water of 100 milliliters to 150 milliliters. Here, the electrolytic water is obtained by preparing about 1% of NaCl aqueous solution using primary sodium chloride, and Isoton II (Coulter Co.) can be used for that. Then, sample to be measured is further added thereto by 2 milligrams to 20 milligrams. An electrolyte with the sample suspended therein is dispersed for about 1 minute to 3 minutes by an ultrasonic disperser, and toner particles or a volume and the number of toner particles are measured by the measurement device using a 100-micrometer aperture, to calculate a volume distribution and a number distribution. The weight-average particle size (D4) and the number-average particle size (D1) of toner particles can thereby be determined.

As a channel, 13 channels as follows are used: 2.00 to less than 2.52 micrometers; 2.52 to less than 3.17 micrometers; 3.17 to less than 4.00 micrometers; 4.00 to less than 5.04 micrometers; 5.04 to less than 6.35 micrometers; 6.35 to less than 8.00 micrometers; 8.00 to less than 10.08 micrometers; 10.08 to less than 12.70 micrometers; 12.70 to less than 16.00 micrometers; 16.00 to less than 20.20 micrometers; 20.20 to less than 25.40 micrometers; 25.40 to less than 32.00 micrometers; and 32.00 to less than 40.30 micrometers. Target particles are those with particle sizes from not less than 2.00 micrometers to less than 40.30 micrometers.

Toner with a nearly spherical shape can be manufactured by performing cross linked and/or elongation reaction between toner compositions that include polyester prepolymer containing functional group including nitride atom and also include polyester, a colorant, and a releasing agent, under the presence of resin fine particles in a water-based solvent. Component materials and a manufacturing method of toner are explained below.

Polyester is obtained by a polycondensation reaction of a polyhydric alcohol compound and a polycarboxylic compound.

Dihydric alcohols (DIO) and trihydric or higher polyhydric alcohols (TO) are examples of the polyhydric alcohol compounds (PO). (DIO) by itself or a mixture of (DIO) and a small amount of (TO) is desirable as (PIO). Alkylene glycols (ethylene glycol, 1,2-propylene glycol, 1,3-propylene glycol, 1,4-butane diol, 1,6-hexane diol etc.), alkylene ether glycols (diethylene glycol, triethylene glycol, dipropylene glycol, polyethylene glycol, polypropylene glycol, polytetramethylene ether glycol etc.), alicyclic diols (1,4-cyclohexane dimethanol, hydrogenated bisphenol A etc.), bisphenols (bisphenol A, bisphenol F, bisphenol S etc.), alkylene oxide adducts (ethylene oxide, propylene oxide, butylene oxide etc.) of the alicyclic diols mentioned earlier, and alkylene oxide adducts (ethylene oxide, propylene oxide, butylene oxide etc.) of the bisphenols mentioned earlier are examples of dihydric alcohols (DIO). Alkylene glycols of carbon number 2 to 12 and alkylene oxide adducts of bisphenols are desirable as dihydric alcohols. Alkylene oxide adducts of bisphenols and a combination of alkylene oxide adducts of bisphenols and alkylene glycols of carbon number 2 to 12 are especially desirable as dihydric alcohols. Examples of trihydric or higher polyhydric alcohols (TO) are trihydric to octahydric alcohols or higher polyaliphatic alcohols (glycerin, trimethylol ethane, trimethylol propane, pentaerythritol, sorbitol etc.), triphenols or higher polyphenols (such as trisphenol PA, phenol novolac, cresol novolac etc.), and alkylene oxide adducts of the triphenols or higher polyphenols mentioned earlier.

Examples of the polycarboxylic acids (PC) are dicarboxylic acid (DIC) and tricarboxylic or higher polycarboxylic acids (TC). (DIC) by itself or a mixture of (DIC) and a small amount of (TC) is desirable as (PC). Examples of the dicarboxylic acids (DIC) are alkylene dicarboxylic acids (succinic acid, adipic acid, sebacic acid etc.), alkenylene dicarboxylic acids (maleic acid, fumaric acid etc.), aromatic carboxylic acids (phthalic acid, isophthalic acid, terephthalic acid, naphthalene dicarbonic acid etc.). Alkenylene dicarboxylic acids of carbon number 4 to 20 and aromatic dicarboxylic acids of carbon number 8 to 20 are desirable as dicarboxylic acids (DIC). Examples of tricarboxylic or higher polycarboxylic acids (TC) are aromatic polycarboxylic acids of carbon number 9 to 20 (trimellitic acid, pyromellitic acid etc.). Further, causing acid anhydrides of the compounds mentioned earlier, or lower alkyl esters (methyl ester, ethyl ester, isopropyl ester etc.) to react with the polyhydric alcohols (PO) also enables to obtain the polycarboxylic acids (PC).

A ratio of the polyhydric alcohols (PO) and the polycarboxylic acids (PC), which is expressed as an equivalent ratio (OH)/(COOH) of a hydroxyl group (OH) and a carboxyl group (COOH) is normally 2/1 to 1/1. A ratio of 1.5/1 to 1/1 is desirable, and a ratio of 1.3/1 to 1.02/1 is further desirable.

In the polycondensation reaction of the polyhydric alcohols (PO) and the polycarboxylic acids (PC), the polyhydric alcohols (PO) and the polycarboxylic acids (PC) are heated to 150° C. to 280° C. in the presence of a commonly known esterification catalyst such as tetra butoxy titanate, dibutyltin oxide etc. Pressure is reduced if required and water generated during the reaction is distilled to obtain a polyester that includes a hydroxyl group. A hydroxyl group number of greater than or equal to 5 is desirable for the polyester. An acid number of the polyester is normally 1 to 30, and an acid number of 5 to 20 is desirable. Causing the polyester to include the acid number increases the negative electrostatic charge of the toner. Further, when fixing the toner on a recording sheet, the acid number enhances affinity of the recording sheet and the toner and also enhances low temperature fixability. However, if the acid number exceeds 30, a stability of the electrostatic charge is adversely affected, especially with respect to environmental variations.

A weight average molecular weight of the polyester is 10000 to 400,000 and a weight average molecular weight of 20000 to 200,000 is desirable. A weight average molecular weight of less than 10000 causes anti-offset ability of the toner to deteriorate and is not desirable. Further, the weight average molecular weight exceeding 400,000 causes the low temperature fixability of the toner to deteriorate and is not desirable.

Apart from the unmodified polyester, which is obtained by the polycondensation reaction mentioned earlier, a urea modified polyester is also desirable and included. For obtaining the urea modified polyester, a carboxyl group or a hydroxyl group at the end of the polyester, which is obtained by the polycondensation reaction, is caused to react with a polyisocyanate compound (PIC) to get a polyester prepolymer (A) that includes an isocyanate group. The polyester prepolymer (A) is caused to react with amines and during the reaction, a molecular chain is subjected to any one of the crosslinking reaction or the elongation reaction or both to obtain the urea modified polyester.

Examples of polyisocyanate compounds (PIC) are aliphatic polyisocyanates (tetramethylene diisocyanate, hexamethylene diisocyanate, 2,6-diisocyanatomethyl caproate etc.), alicyclic polyisocyanates (isophorone diisocyanate, cyclohexyl methane diisocyanate etc.), aromatic diisocyanates (tolylene diisocyanate, diphenyl methane diisocyanate etc.), aromatic aliphatic diisocyanates ($\alpha,\alpha,\alpha',\alpha'$-tetramethyl xylylene diisocyanate etc.), isocyanates, compounds that are obtained by blocking the polyisocyanates mentioned earlier using phenol derivatives, oximes, caprolactum etc., and combinations of two or more types of the compounds mentioned earlier.

A ratio of the polyisocyanate compounds (PIC) which is expressed as an equivalent ratio (NCO)/(OH) of an isocyanate group (NCO) and a hydroxyl group (OH) of the polyester that includes a hydroxyl group, is normally 5/1 to 1/1. A ratio of 4/1 to 1.2/1 is desirable, and a ratio of 2.5/1 to 1.5/1 is further desirable. If the ratio of (NCO)/(OH) exceeds 5, the low temperature fixability of the toner deteriorates. If a mole ratio of (NCO) is less than one, when using the urea modified polyester, a urea content in the polyester decreases and the anti-offset ability of the toner deteriorates.

An amount of the polyisocyanate compound (PIC) component in the polyester prepolymer (A) that includes an isocyanate group is normally 0.5% to 40% by weight. An amount of 1% to 30% by weight is desirable, and an amount of 2% to 20% by weight is further desirable. If the amount of the polyisocyanate compound (PIC) component is less than 0.5% by weight, the anti-offset ability of the toner deteriorates and maintaining a balance between heat resistant storability and the low temperature fixability of the toner becomes difficult. Further, if the amount of the polyisocyanate compound (PIC) component exceeds 40% by weight, the low temperature fixability of the toner deteriorates.

A number of isocyanate groups included in the polyester prepolymer (A) per molecule is normally greater than or equal to one. An average of 1.5 to 3 isocyanate groups per molecule are desirable and an average of 1.8 to 2.5 isocyanate groups per molecule are further desirable. If the number of isocyanate groups per molecule is less than one, a molecular weight of the urea modified polyester decreases and the anti-offset ability of the toner deteriorates.

Examples of amines (B) which are caused to react with the polyester prepolymer (A) are diamine compounds (B1), triamines or higher polyamine compounds (B2), amino alcohols (B3), amino mercaptans (B4), amino acids (B5), and compounds (B6) in which amino groups of B1 to B5 are blocked.

Examples of the diamine compounds (B1) are aromatic diamines (phenylene diamine, diethyl toluene diamine, 4,4'-diamineodiphenyl methane etc.), alicyclic diamines (4,4'-diamino-3,3'-dimethyl dicyclohexyl methane, diamine cyclohexane, isophorone diamine etc.), and aliphatic diamines (ethylene diamine, tetramethylene diamine, hexamethylene diamine etc.). Examples of the triamines or higher polyamine compounds (B2) are diethylene triamine and triethylene tetramine. Examples of the amino alcohols (B3) are ethanolamine and hydroxyethyl aniline. Examples of the amino mercaptans (B4) are aminoethyl mercaptan and aminopropyl mercaptan. Examples of the amino acids (B5) are aminopropionic acid and aminocaproic acid. Ketimine compounds and oxazolidine compounds, which are obtained from the amines B1 to B5 mentioned earlier and ketones (acetone, methyl ethyl ketone, methyl isobutyl ketone etc.), are examples of the compounds (B6) wherein the amino groups of B1 to B5 are blocked. Among the amines (B), the diamine compounds of B1 and the compounds that include B1 and a small amount of B2 are desirable.

A ratio of the amines (B), which is expressed as an equivalent ratio (NCO)/(NHx) of an isocyanate group (NCO) from the polyester prepolymer (A) that includes the isocyanate group and an amino group (NHx) from the amines (B), is normally 1/2 to 2/1. A ratio of 1.5/1 to 1/1.5 is desirable, and a ratio of 1.2/1 to 1/1.2 is further desirable. If the ratio (NCO)/(NHx) becomes greater than 2 or less than 1/2, the molecular weight of the urea modified polyester is reduced and the anti-offset ability of the toner deteriorates.

The urea modified polyester can also include urethane linkages along with urea linkages. A mole ratio of an amount of the urea linkages and an amount of the urethane linkages is normally 100/0 to 10/90. A mole ratio of 80/20 to 20/80 is desirable and a mole ratio of 60/40 to 30/70 is further desirable. If the mole ratio of the urea linkages is less than 10 percent, the anti-offset ability of the toner deteriorates.

The urea modified polyester is manufactured using a one shot method etc. The polyhydric alcohols (PO) and the polycarboxylic acids (PC) are heated to 150° C. to 280° C. in the presence of a commonly known esterification catalyst such as tetra butoxy titanate, dibutyltin oxide etc. Pressure is reduced if required and water generated during the reaction is distilled to obtain the polyester that includes the hydroxyl group. Next, the polyester is caused to react with polyisocyanate (PIC) at 40° C. to 140° C. to get the polyester prepolymer (A) that includes an isocyanate group. Next, the polyester prepolymer (A) is caused to react with the amines (B) at 0° C. to 140° C. to get the urea modified polyester.

When causing the polyester to react with (PIC) and when causing (A) to react with (B), a solvent can also be used if required. Examples of the solvents that can be used are aromatic solvents (toluene, xylene etc.), ketones (acetone, methyl isobutyl ketone etc.), esters (ethyl acetate etc.), amides (dimethyl formamide, dimethyl acetoamide etc.), and ethers (tetrahydrofuran etc.) that are inactive with respect to the isocyanates (PIC).

Further, during any one of the crosslinking reaction or the elongation reaction or both between the polyester prepolymer (A) and the amines (B), a reaction terminator can also be used if required and the molecular weight of the obtained urea modified polyester can be regulated. Examples of the reaction terminator are monoamines (diethylamine, dibutylamine, butylamine, laurylamine etc.) and compounds (ketimine compounds) in which the monoamines are blocked.

The weight average molecular weight of the urea modified polyester is normally greater than or equal to 10,000. A weight average molecular weight of 20,000 to 100,000,000 is desirable and a weight average molecular weight of 30,000 to 1,000,000 is further desirable. If the weight average molecular weight of the urea modified polyester is less than 10,000, the anti-offset ability of the toner deteriorates. When using the unmodified polyester, a number average molecular weight of the urea modified polyester is not especially limited, and any number average molecular weight that is easily converted into the weight average molecular weight can be used. When using the urea modified polyester by itself, the number average molecular weight of the urea modified polyester is normally 2,000 to 15,000. A number average molecular weight of 2,000 to 10,000 is desirable and a number average molecular weight of 2,000 to 8,000 is further desirable. The number average molecular weight of the urea modified polyester exceeding 20,000 results in deterioration of the low temperature fixability and the gloss of the toner when the toner is used in a full color device.

Using a combination of the unmodified polyester and the urea modified polyester enables to enhance the low temperature fixability of the toner and the gloss when the toner is used in a full color image forming apparatus 100. Thus, using a combination of the unmodified polyester and the urea modified polyester is desirable than using the urea modified polyester by itself. Further, the unmodified polyester can also include polyester that is modified using chemical linkages other than the urea linkages.

At least a portion of the unmodified polyester and the urea modified polyester being mutually compatible is desirable for the low temperature fixability and the anti-offset ability. Thus, a similar composition of the unmodified polyester and the urea modified polyester is desirable.

A weight ratio of the unmodified polyester and the urea modified polyester is normally 20/80 to 95/5. A weight ratio of 70/30 to 95/5 is desirable, a weight ratio of 75/25 to 95/5 is further desirable, and a weight ratio of 80/20 to 93/7 is especially desirable. If the weight ratio of the urea modified polyester is less than 5 percent, the anti-offset ability of the toner deteriorates and maintaining a balance between heat resistant storability and the low temperature fixability of the toner becomes difficult.

A glass transition point ($T_g$) of a binder resin that includes the unmodified polyester and the urea modified polyester is normally 45° C. to 65° C. A glass transition point of 45° C. to 60° C. is desirable. If the glass transition point is less than 45° C., a heat resistance of the toner deteriorates. If the glass transition point exceeds 65° C., the low temperature fixability of the toner becomes insufficient.

Because the urea modified polyester is likely to remain on the surface of the obtained parent toner particles, regardless of the low glass transition point, heat resistant storability of the toner is favorable compared to a commonly known polyester type toner.

All commonly known dyes and pigments can be used as colorants. Examples of the colorants that can be used are carbon black, nigrosine dye, iron black, naphthol yellow S, hansa yellow (10G, 5G, G), cadmium yellow, yellow iron oxide, yellow ocher, chrome yellow, titanium yellow, polyazo yellow, oil yellow, hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, minium, red lead, cadmium red, cadmium mercury red, antimony vermilion, permanent red 4R, para red, fire red, parachloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, Bordeaux 5B, toluidine maroon, permanent bordeaux F2K, helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue alkali blue lake, peacock blue lake, Victoria blue lake, metal-free phthalocyanine blue, phthalocyanine blue, fast sky blue, indanthrene blue (RS, BC), indigo, ultramarine blue, Prussian blue, anthraquinone blue, fast violet B, methyl violate lake, cobalt purple, Manganese purple, dioxane violate, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, lithopone and mixtures of the colors mentioned earlier. A colorant content is normally 1% to 15% by weight with respect to the toner, and a colorant content of 3% to 10% by weight is desirable.

The colorant can also be used as a master batch that is combined with the resin. Styrenes such as polystyrene, poly-p-chlorostyrene, polyvinyl toluene, substitute polymers of the styrenes mentioned earlier, copolymers of the styrenes mentioned earlier with vinyl compounds, polymethyl methacrylate, polybutyl methacrylate, polyvinyl chloride, polyvinyl acetater, polyethylene, polypropylene, polyester, epoxy resin, epoxypolyol resin, polyurethane, polyamide, polyvinyl butylal, polyacrylic acid resin, rodine, modified rodine, terpene resin, aliphatic or alicyclic hydrocarbon resin, aromatic petroleum resin, chlorinated paraffin, paraffin wax etc. are examples of the binder resins that are used in the manufacture of the master batch or that are mixed with the master batch. The binder resins mentioned earlier can be used independently or as a mixture.

Commonly known electric charge controllers can be used. Examples of the electric charge controllers are nigrosine dyes, triphenyl methane dyes, chromium-containing metal complex dyes, chelate molybdate pigment, rhodamine dyes, alkoxy amine, quaternary ammonium salt (includes fluorine modified quaternary ammonium salt), alkyl amide, phosphorus in element or compound form, tungsten in element or compound form, fluorine series activator, salicylic acid metal salt and metal salt of salicylic acid derivative. Specific examples of the electric charge controllers are bontron 03 that is a nigrosine series dye, bontron P-51 that is a quaternary ammonium salt, bontron S-34 that is a metal-containing azo dye, E-82 that is an oxynaphthoe acid metal complex, E-84 that is a salicylic acid metal complex, E-89 that is a phenol condensate (the chemicals mentioned earlier are manufactured by Orient Chemical Industries), TP-302 that is a quaternary ammonium salt molybdenum complex, TP-415 (the chemicals mentioned earlier are manufactured by Hodogaya Chemicals Company), copy charge PSY VP2038 that is a quaternary ammonium salt, copy blue PR that is a triphenyl methane derivative, copy charge NEG VP2036 that is a quaternary ammonium salt, copy charge NX VP434 (the chemicals mentioned earlier are manufactured by Hochst Company), LRA-901, LR-147 that is a boron complex (manufactured by Japan Carlit Company), copper phthalocyanine, perylene, quinacridone, azo type pigment, and other polymeric compounds that include functional groups such as sulfonic acid group, carboxyl group, quaternary ammonium salt etc. Among the materials mentioned earlier, the materials that especially control the toner to the negative polarity are desirably used. A usage amount of the electric charge controller is decided according to a toner manufacturing method that includes a type of the binder resin, presence of the additive agent that is used if necessary, a dispersion method etc. Thus, the usage amount of the electric charge controller is not uniquely limited. However, the usage amount in a range of 0.1 to 10 parts by weight of the electric charge controller with respect to 100 parts by weight of the binder resin is desirably used. A range of 0.2 to 5 parts by weight of the electric charge controller is desirable. If the usage amount of the electric charge controller exceeds 10 parts by weight, the excess electrostatic charge of the toner reduces the effect of the electric charge controller and increases the electrostatic attraction between the toner and the developing roller. Due to this, fluidity of the developer and image density are reduced.

When dispersed with the binder resin, wax which includes a low melting point of 50° C. to 120° C. functions effectively as the mold releasing agent between a fixing roller and a toner surface. Due to this, wax is effective against heat offset and removes a necessity to coat the fixing roller with the mold releasing agent. Examples of materials, which are used as a wax component, are described below. Examples of wax materials are plant wax such as carnauba wax, cotton wax, wood wax, rice wax etc., animal wax such as beeswax, lanolin etc., mineral wax such as ozokerite, cercine etc., and petroleum wax such as paraffin, microcrystalline, petrolatum etc. Further, apart from natural wax mentioned earlier, synthetic hydrocarbon wax such as Fischer-Tropsch wax, polyethylene wax, and synthetic wax such as ester, ketone, and ether can also be used. Further, fatty amides such as 1,2-hydroxystearic acid amide, stearic acid amide, phthalic anhydride imide, chlorinated hydrocarbon, and crystalline polymer molecules that include a long alkyl group in a side chain, in other words, polyacrylate homopolymers or copolymers (for example, copolymers of n-stearyl acrylate-ethyl methacrylate etc.) such as poly-n-stearyl methacrylate, poly-n-lauryl methacrylate can also be used.

The electric charge controller and the mold releasing agent can also be melted and mixed with the master batch and the binder resin. Further, the electric charge controller and the mold releasing agent can also be added when the master batch and the binder resin are dissolved and dispersed in the organic solvent.

Inorganic particles are desirably used as the external additive agent for supplementing fluidity, developability, and electrostatic charge of the toner. A primary particle diameter of $5\times10^{-3}$ to 2 μm is desirable for the inorganic particles and a primary particle diameter of $5\times10^{-3}$ to 0.5 μm is further desirable. Further, a specific surface area of 20 to 500 $m^2/g$ according to Brunauer Emmet Teller (BET) method is desirable for the inorganic particles. A usage percentage of 0.01% to 5% by weight of the toner is desirable for the inorganic particles and a usage percentage of 0.01% to 2.0% by weight is especially desirable.

Specific examples of the inorganic particles are silica, alumina, titanium oxide, barium titanate, magnesium titanate, calcium titanate, strontium titanate, zinc oxide, tin oxide, silica sand, clay, mica, silica apatite, diatomite, chromium oxide, serium oxide, colcothar, antimony trioxide, magnesium oxide, zirconium oxide, barium sulphate, barium carbonate, calcium carbonate, silicon carbide, silicon nitride etc. Especially, using a combination of hydrophobic silica particles and hydrophobic titanium oxide particles as a fluidity enhancer is desirable. Especially, if hydrophobic silica particles and hydrophobic titanium oxide particles having an average particle diameter of less than or equal to $5\times10^{-2}$ μm are mixed by stirring, electrostatic power and van der Waals power of the toner are significantly enhanced. Due to this, the fluidity enhancer is not detached from the toner even if the fluidity enhancer is mixed by stirring inside a developing device for getting a desired electrostatic charge level. Thus, a better image quality can be obtained by preventing occurrence of dots and the transfer residual toner can be reduced.

Although using the titanium oxide particles is desirable for better environmental stability and image density stability, because a charge rising property of the toner increasingly deteriorates, if an additive amount of the titanium oxide particles becomes more than an additive amount of the silica particles, influence of the side effect mentioned earlier is likely to increase. However, if the additive amounts of the hydrophobic silica particles and the hydrophobic titanium oxide particles are in a range of 0.3% to 1.5% by weight, the charge rising property of the toner is not significantly affected and a desired charge rising property can be obtained. In other words, a stable image quality can be obtained even if the image is repeated copied.

The manufacturing method of the toner is explained next. Although the manufacturing method explained below is desirable, the present invention is not to be thus limited.

First, the coloring agent, the unmodified polyester, the polyester prepolymer that includes an isocyanate group, and the mold releasing agent are dispersed in the organic solvent to form the toner material solution.

A volatile organic solvent having a boiling point of less than 100° C. is desirable for easy removal of the organic solvent after formation of the parent toner particles. To be specific, toluene, xylene, benzene, tetrachlorocarbon, chloromethylene, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone etc. can be used alone or a combination of two or more chemicals mentioned earlier can be used. Especially, aromatic solvents such as toluene, xylene and halogenated hydrocarbons such as chloromethylene, 1,2-dichloroethane, chloroform, tetrachlorocarbon are desirable. A usage amount of the organic solvent is normally 0 to 300 parts by weight of the organic solvent with respect to 100 parts by weight of the polyester prepolymer. A usage amount of 0 to 100 parts by weight of the organic solvent is desirable and a usage amount of 25 to 70 parts by weight of the organic solvent is further desirable.

Next, the toner material solution is emulsified in the aqueous solvent in the presence of a surface active agent and resin particles.

Water alone can be used as the aqueous solvent. Further, aqueous solvents that include organic solvents such as alcohols (methanol, isopropyl alcohol, ethylene glycol etc.), dimethyl formamide, tetrahydrofuran, cellosolves (methyl cellosolve etc.), lower ketones (acetone, methyl ethyl ketone etc.) can also be used.

A usage amount of the aqueous solvent is normally 50 to 2000 parts by weight of the aqueous solvent with respect to 100 parts by weight of the toner material solution. A usage amount of 100 to 1000 parts by weight of the aqueous solvent is desirable. If the usage amount of the aqueous solvent becomes less than 50 parts by weight, the dispersed state of the toner material solution deteriorates and toner particles of a predetermined particle diameter cannot be obtained. If the usage amount of the aqueous solvent exceeds 20000 parts by weight, toner manufacturing is not economical.

A dispersing agent such as the surface active agent or the resin particles is suitably added for enhancing the dispersion in the aqueous solvent. Examples of the surface active agent are anionic surface active agents such as alkylbenzene sulfonate, α-olefine sulfonate, ester phosphate, amine salts such as alkylamine salts, amino alcohol fatty acid derivatives, polyamine fatty acid derivatives, imidazolin, cationic surface active agent of quaternary ammonium salt type such as alkyl trimethyl ammonium salt, dialkyl dimethyl ammonium salt, alkyl dimethyl benzyl ammonium salt, pyridium salt, alkyl isoquinolium salt, chlorobenzetonium, nonionic surface active agent such as fatty acid amide derivatives, polyhydric alcohol derivatives, and zwitterionic surface active agent such as alanine, dodecyldi (aminoethyl)glycine, di(octylaminoethyl)glycine, N-alkyl-N,N-dimethyl ammonium betaine.

Using the surface active agent that includes a fluoroalkyl group enables to enhance the effect of the surface active agent using an extremely small amount of the surface active agent. Examples of desirably used anionic surface active agents that include a fluoroalkyl group are fluoroalkyl carboxylic acids of carbon number 2 to 10 and metal salts of the fluoroalkyl carboxylic acids, perfluorooctane sulfonyl dinatrium gultaminate, 3-(ω-fluoroalkyl (C6 to C11) oxy)-1-alkyl (C3 to C4) natrium sulfonate, 3-(ω-fluoroalkanoyl (C6 to C8)-N-ethylamino)-1-propane natrium sulfonate, fluoroalkyl (C11 to C20) carboxylic acid and metal salts of fluoroalkyl (C11 to C20) carboxylic acid, perfluoroalkyl carboxylic acid (C7 to C13) and metal salts of perfluoroalkyl carboxylic acid (C7 to C13), perfluoroalkyl (C4 to C12) sulfonic acid and metal salts of perfluoroalkyl (C4 to C12) sulfonic acid, perfluorooctane sulfonic acid diethanol amide, N-propyl-N-(2-hydroxyethyl perfluorooctane sulfonic amide, perfluoroalkyl (C6 to C10) sulfonic amide propyl trimethyl ammonium salt, perfluoroalkyl (C6 to C10)-N-ethylsulfonyl glycine salt, monoperfluoroalkyl (C6 to C16) ethyl phosphoric acid ester etc.

Examples of product names are saflon S-111, S-112, S-113 (manufactured by Asahi Glass Company), flolard FC-93, FC-95, FC-98, FC-129 (manufactured by Sumitomo 3M Company), unidine DS-101, DS-102 (manufactured by Daikin Industries Company), megafac F-110, F-120, F-113, F-191, F-812, F-833 (manufactured by Dai Nihon Ink Company), ektop EF-102, 103, 104, 105, 112, 123A, 123B, 306A, 501, 201, 204 (manufactured by Tohkem Products Company), futargent F-100, F-150 (manufactured by Neos Company) etc.

Examples of the cationic surface active agent are aliphatic primary or secondary amino acids that include a fluoroalkyl group, aliphatic quaternary ammonium salts such as perfluoroalkyl (C6 to C10) sulfonic amide propyl trimethyl ammonium salt, benzalkonium salt, benzetonium chloride, pyridium salt, and imidazolium salt. Examples of product names are saflon S-121 (manufactured by Asahi Glass Company), flolard FC-135 (manufactured by Sumitomo 3M Company), unidine DS-202 (manufactured by Daikin Industries Company), megafac F-150, F-824 (manufactured by Dai Nihon Ink Company), ektop EF-132 (manufactured by Tohkem Products Company), and futargent F-300 (manufactured by Neos Company) etc.

The resin particles are added for stabilizing the parent toner particles that are formed in the aqueous solvent. To stabilize the parent toner particles, the resin particles are desirably added such that a surface coverage of the resin particles on the surface of the parent toner particles is in a range of 10 to 90 percent. Examples of the resin particles are methyl polymethacrylate particles of 1 (μm) and 3 (μm), polystyrene particles of 0.5 (μm) and 2 (μm), poly(styrene-acryronitrile) particles of 1 (μm) etc. Examples of product names are PB-200H (manufactured by Kao Company), SGP (manufactured by Soken Company), technopolymer-SB (manufactured by Sekisui Plastics Company), SGP-3G (manufactured by Soken Company), micropearl (manufactured by Sekisui Fine Chemicals Company) etc. Further, inorganic compound dispersing agents such as tricalcium phosphate, calcium carbonate, titanium oxide, colloidal silica, hydroxyapatite etc. can also be used.

Dispersion droplets of the resin particles mentioned earlier can also be stabilized as the dispersing agent that can be used in combination with the inorganic compound dispersing agent by using a polymeric protecting colloid. Examples of the polymeric protecting colloids that can be used are acids such as acrylic acid, methacrylic acid, α-cyanoacrylic acid, α-cyanomethacrylic acid, itaconic acid, crotonic acid, fumaric acid, maleic acid or maleic anhydride, methacrylic monomers that include a hydroxyl group, for example, acrylic acid-β-hydroxyethyl, methacrylic acid-β-hydroxyethyl, acrylic acid-β-hydroxypropyl, methacrylic acid-β-hydroxypropyl, acrylic acid-γ-hydroxypropyl, methacrylic acid-γ-hydroxypropyl, acrylic acid-3-chloro-2-hydroxypropyl, methacrylic acid-3-chloro-2-hydroxypropyl, diethylene glycol monoacrylic acid ester, diethylene glycol monomethacrylic acid ester, glycerin monoacrylic acid ester, glycerin mono methacrylic acid ester, N-methylol acrylic amide, N-methylol methacrylic amide etc., vinyl alcohol or ethers with vinyl alcohol, for example, vinyl methyl ether, vinyl ethyl ether, vinyl propyl ether etc., esters of compounds that include a vinyl alcohol and a carboxyl group, for example, vinyl acetate, vinyl propionate, vinyl butyrate etc., acrylic amide, methacrylic amide, diacetone acrylic amide or methylol compounds of acrylic amide, methacrylic amide, and diacetone acrylic amide, acid chlorides such as chloride acrylate, methacrylic chloride, nitrogen containing compounds, for example, vinyl pyridine, vinyl pyrrolidone, vinyl imidazol, ethyleneimine etc. or heterocyclic homopolymers or copolymers of the nitrogen containing compounds, polyoxyethylenes, for example, polyoxyethylene, polyoxypropylene, polyoxyethylene alkylamine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, polyoxyethylene nonylphenyl ester etc., and celluloses, for example, methyl cellulose, hydroxy ethyl cellulose, hydroxy propyl cellulose etc.

The dispersion method is not limited to any specific method, and commonly known methods such as a low speed shearing method, a high speed shearing method, a friction method, a high pressure jet method can be applied. The high speed shearing method is desirable for ensuring a particle diameter of 2 to 20 μm for a dispersion element. When using a high speed shearing method dispersing device, although a number of revolutions is not limited to a specific number, the number of revolutions is normally 1000 to 30000 revolutions per minute (rpm), and a number of 5000 to 20000 rpm is desirable. Although a dispersion time period is not limited to a specific time period, when using a batch method, the dispersion time period is normally 0.1 to 5 minutes. Normally, the dispersion is carried out at a temperature of 0° to 150° C. (under pressure) and a temperature of 40° to 98° C. is desirable.

Next, along with preparation of an emulsified liquid, the amines (B) are simultaneously added and the emulsified liquid is caused to react with the polyester prepolymer (A) that includes an isocyanate group.

During the reaction mentioned earlier, the molecular chain is subjected to any one of the crosslinking reaction or the elongation reaction or both. Although a reaction time period is selected based on a reactivity of an isocyanate group structure included in the polyester prepolymer (A) with the amines (B), the reaction time period is normally 10 minutes to 40 hours, and a reaction time period of 2 to 24 hours is desirable. A reaction temperature is normally 0° C. to 150° C. and a reaction temperature of 40° C. to 98° C. is desirable. A commonly known catalyst can be used if required. To be specific, a catalyst such as dibutyltin laurate or dioctyltin laurate can be used.

After completion of the reaction, the organic solvent is removed from the emulsified dispersion element (reaction product) and the reaction product is cleaned and dried to get the parent toner particles.

For removing the organic solvent, the temperature is gradually increased while stirring a laminar flow of the entire reaction product. After strongly stirring the reaction product at a fixed temperature range, the organic solvent is removed and the spindle shaped parent toner particles can be formed. Further, if a chemical such as a calcium phosphate salt which is soluble in acids and alkalies is used as a dispersion stabilizer, the calcium phosphate salt is dissolved using an acid such as hydrochloric acid and the resulting solution is washed with water to remove the calcium phosphate salt from the toner particles. Further, the calcium phosphate salt can also be removed using an operation such as enzymatic breakdown.

The electric charge controller is added to the parent toner particles that are obtained using the method mentioned earlier, and the inorganic particles such as silica particles and titanium oxide particles are externally added to get the toner.

Addition of the electric charge controller and external addition of the inorganic particles is carried out by a commonly known method that uses a mixer.

Due to this, the toner having a small particle diameter and a sharp particle diameter distribution can be easily obtained. Further, due to strong stirring during the process to remove the organic solvent, a shape of the toner particles can be controlled to a shape between a spherical shape and a rugby ball shape. Further, a surface morphology of the toner particles can also be controlled to between smooth and corrugated.

The developing device according to the present invention using such toner as a developer is provided in the image forming apparatus as shown in FIG. 1. A configuration of the image forming apparatus is explained below.

FIG. 1 is a schematic diagram of the image forming apparatus that includes the developing device according to the present invention. The image forming apparatus is a tandem color printer 1 in which process cartridges as imaging units capable of forming images of a plurality of colors respectively are arranged in parallel. The image forming apparatus according to the present invention also includes a copier, a facsimile device, or a printing machine in addition to the printer.

A configuration of the color printer 1 in FIG. 1 is as follows.

Imaging units 2, 3, 4, and 5 that form images of a plurality of colors respectively are arranged in parallel inside a housing body 1A of the color printer 1. In FIG. 1, images of yellow, cyan, magenta, and black are formed in the imaging units 2, 3, 4, and 5 in this order, respectively.

The imaging units 2, 3, 4, and 5 are units to form images using toners complementary in colors to colors based on an image of an original or image information, respectively. The units are arranged opposed to a transfer unit 6 that has an intermediate transfer element 6A extending along an arrangement direction of the units.

The imaging units 2, 3, 4, and 5 are detachably attached to the housing body 1A of the color printer 1 and are identically configured to one another. The configuration will be explained in detail later with reference to FIG. 2.

Meanwhile, the transfer unit 6 is placed in a position opposed to photosensitive elements of the imaging units 2, 3, 4, and 5 inside the housing body 1A of the color printer 1. The transfer unit 6 includes the intermediate transfer element 6A that has an extension portion extending along the arrangement direction of the imaging units 2, 3, 4, and 5, and a plurality of transfer bias units 6B arranged in positions opposed to the photosensitive elements respectively through the intermediate transfer element 6A.

Provided below the transfer unit 6 is a paper feed unit 7 that feeds out a sheet S of recording paper stored in a paper feed cassette 7A by a feed roller 7B. The fed-out sheet S is fed toward a transfer position with respect to each of the imaging units at a sheet registration timing set by a registration roller 8.

A fixing unit 9 is provided at a location, inside the housing body 1A, that the sheet S having passed through the opposed positions between the imaging units and the transfer unit 6 reaches. The fixing unit 9 fuses a transferred toner image on the sheet S under heat and pressure.

The sheet S with the toner image fixed thereon is ejected toward a paper ejection tray 1B provided on the housing body 1A through a paper ejection unit 10. In FIG. 1, reference numeral 11 represents a writing unit.

A configuration of the developing device is explained below with reference to FIG. 2.

Figure 2:
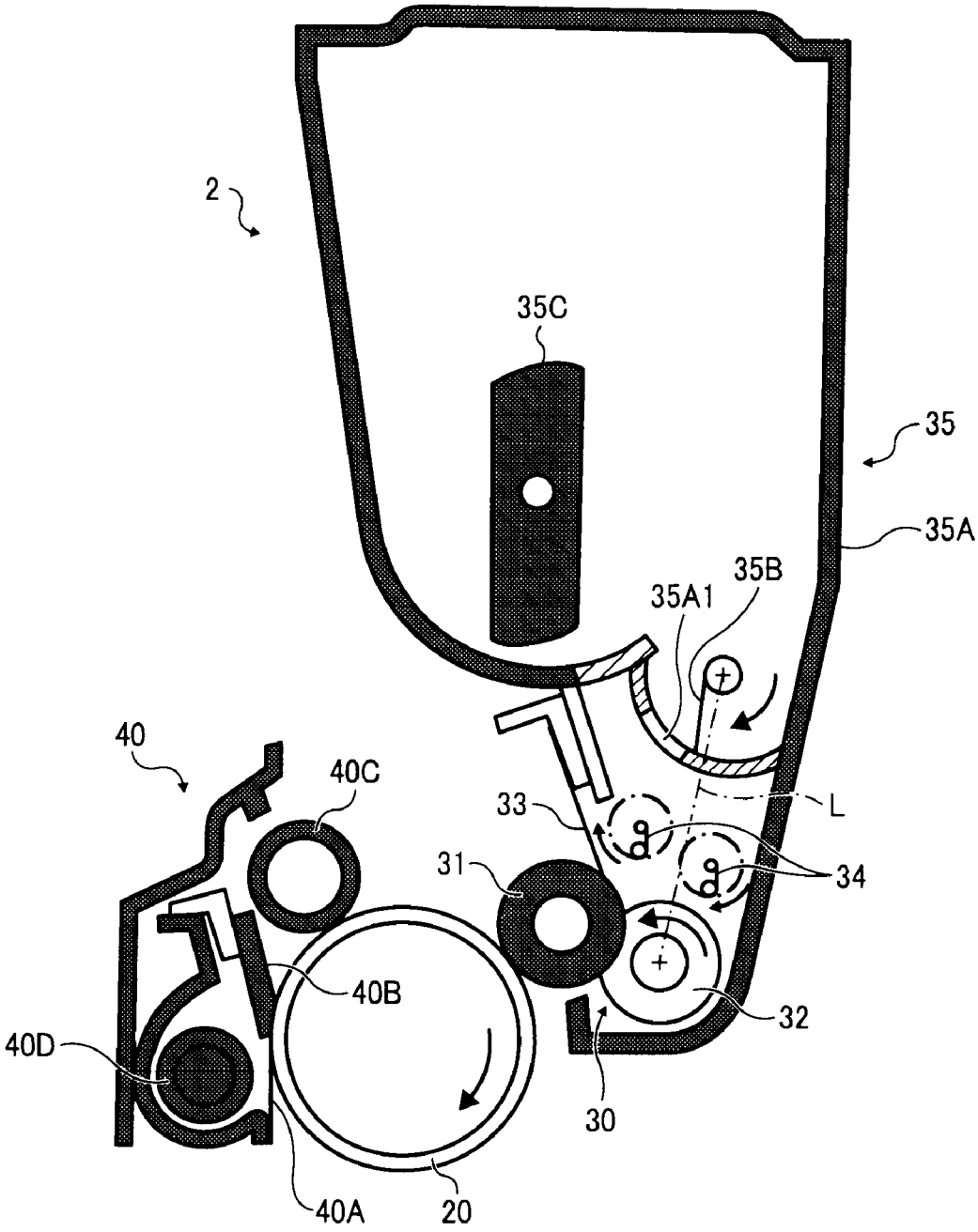
FIG. 2 is a schematic diagram of a process cartridge including the developing device shown in FIG. 1.

FIG. 2 is a schematic diagram of the imaging unit 2 that forms a yellow image, however, the other imaging units have identical configurations thereto.

The imaging unit 2 includes a photosensitive element 20 that is made to rotate in an arrow direction in FIG. 1, a developing device 30 that performs an image visualizing process on an electrostatic latent image formed on the photosensitive element 20, and a cleaning device 40 that collects some of toner remaining on the photosensitive element 20 after transfer of the toner, these components being arranged within the same space of the process cartridge. A configuration of the developing device 30 will be explained in detail later, but a configuration of the cleaning device 40 is briefly explained herein. The cleaning device 40 includes cleaning blades 40A and 40B that come into contact with the photosensitive element 20 and scrape the remaining toner therefrom, and a decharging roller 40C. The toner removed from the photosensitive element 20 is conveyed toward a developer feed member 32 of the developing device 30 by a conveying member 40D such as a collecting screw, and is used as recycled toner.

The configuration of the developing device 30 is explained below. The developing device 30 includes a developing sleeve 31 that carries a developer on the surface thereof and is used to perform a developing process on the photosensitive element 20; the developer feed member 32 formed with a roller that is in contact with the developing sleeve 31 and is rotatably provided; a doctor blade 33 used as the layer-thickness control member that controls the layer thickness of the developer carried on the surface of the developing sleeve 31; a stirring member 34 such as a rotatable paddle used to stir the developer inside a developer tank in which the developer feed member 32 is placed; and a developer supply unit 35.

The developer supply unit 35 includes a vertically long-shaped developer storage tank 35A corresponding to a developer storage unit placed above the developer feed member 32; a developer supply member 35B that is placed near a developer discharge port 35A1 formed in the lower part of the developer storage tank 35A and is rotatable in a clockwise as indicated by arrow; and a developer conveying member 35C that is rotatably provided and conveys the developer stored in the developer storage tank 35A toward the developer discharge port 35A1. A shutter (not shown) that opens and closes the developer discharge port 35A1 may be placed therein so that a discharge amount and a period of discharge can also be controlled. Further, letter L indicates that the developer feed member 32 in the developer tank and the developer supply member 35B in the developer storage tank 35A have a transmission relationship of a driving force.

The doctor blade 33 used as the layer-thickness control member is formed with a stainless-steel thin plate obtained in such a manner that SUS 301-CSP defined in JISG 4313 is subjected to a tempering process for 3/4H, H, or EH or that SUS 304-CSP is subjected to a tempering process for 3/4H and H.

The stainless-steel thin plate formed through rolling has fine streaks like grooves along a rolling direction produced at the process of rolling. Therefore, when the rolling direction and the rotating direction of the developing roller are set in parallel to each other, toner enters into the streaks of the blade to accumulate therein, and the toner is condensed to thereby easily adhere to the blade.

Figure 3A:
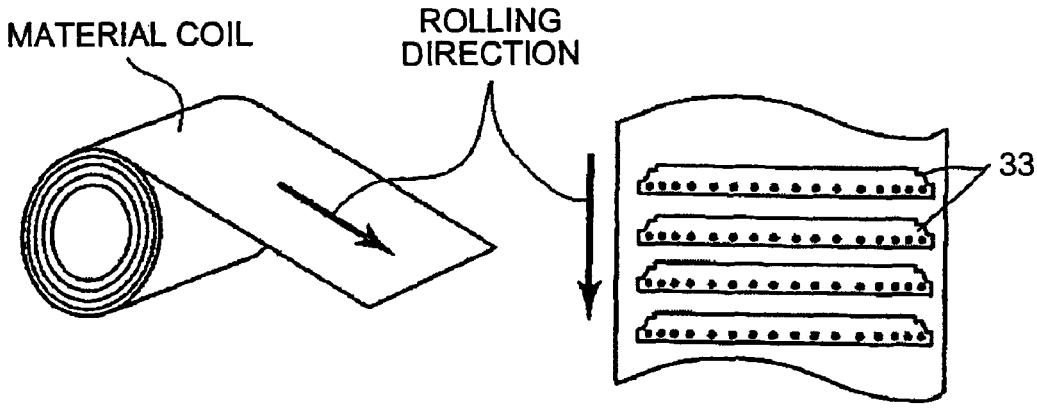
FIG.3A RELATED ART
FIGS. 3A and 3B are schematic diagrams for explaining rolling directions of a doctor blade corresponding to a layer-thickness control member used in the developing device.
Figure 3B:
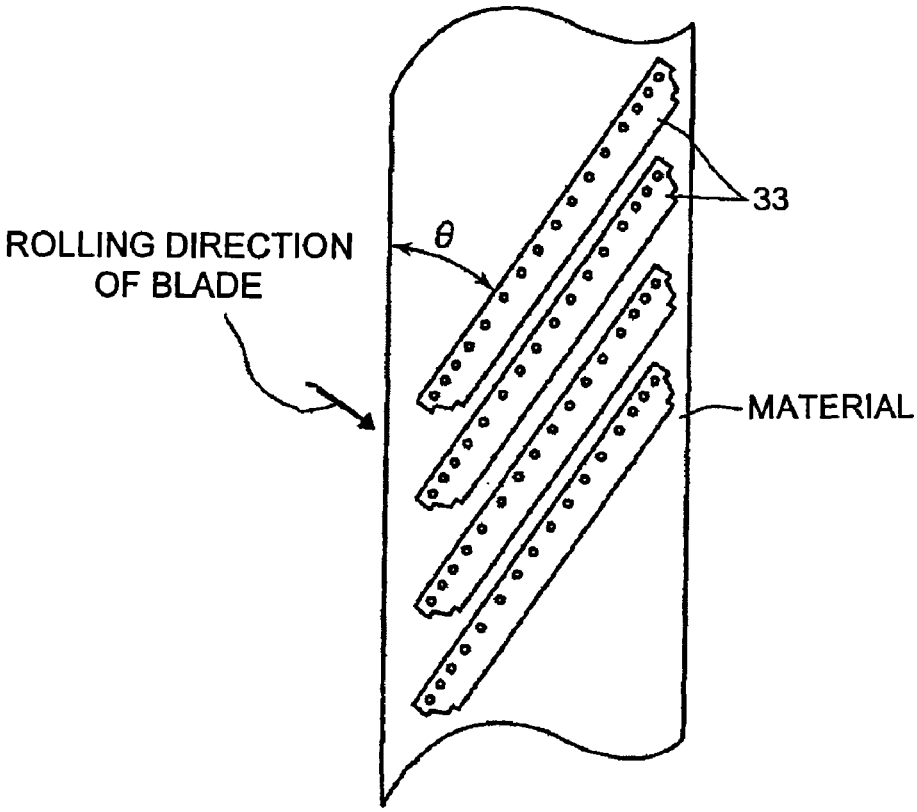

Therefore, in the embodiment, like a conventional structure shown in FIG. 3A, the rolling direction is not set to be parallel to the rotating direction of the developing sleeve 31, but, as shown in FIG. 3B, the rolling direction is set to be inclined at an angle (θ) in a range of θ=5 degrees to 80 degrees with respect to the rotating direction.

Figure 4:
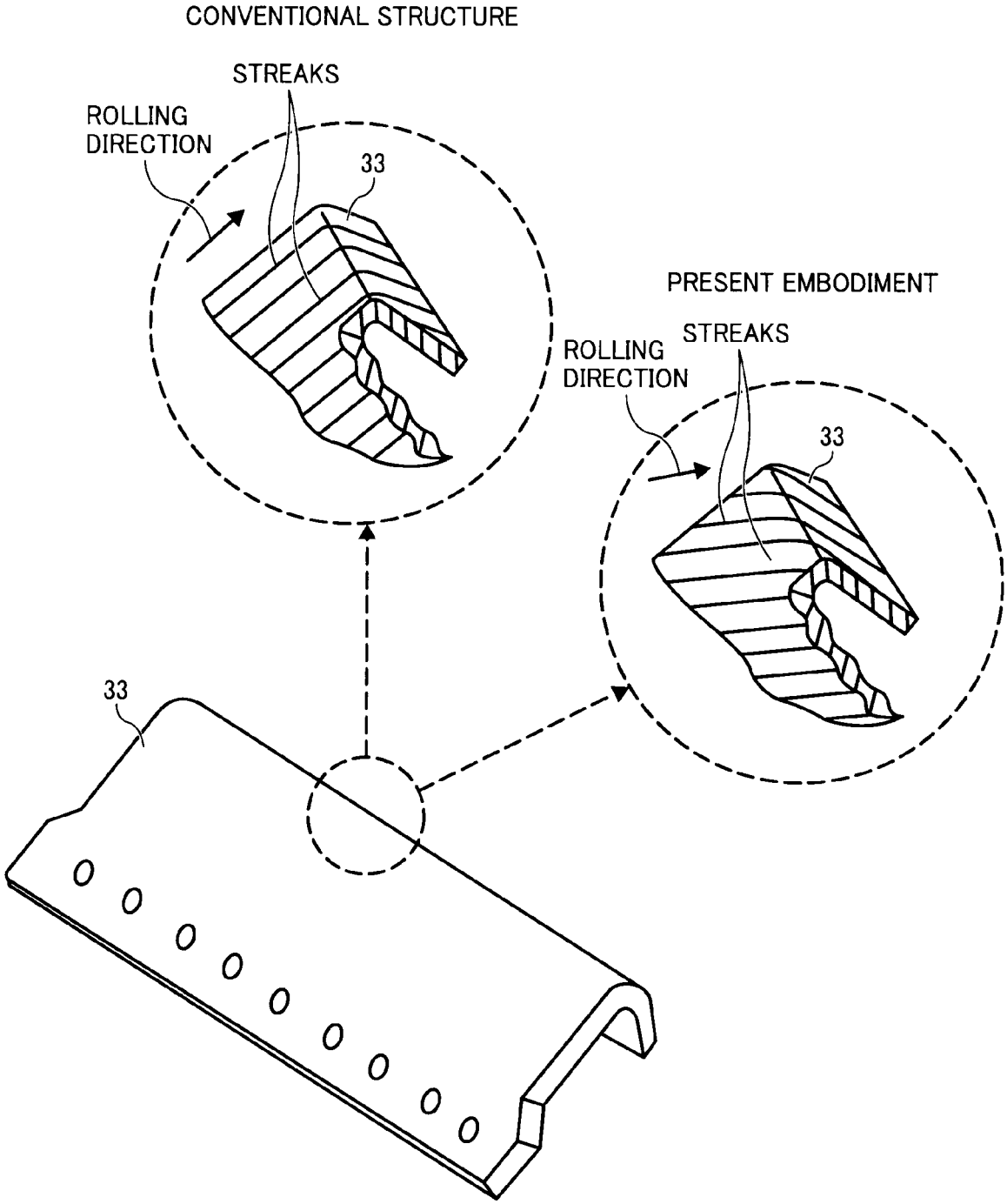
FIG. 4 is a schematic diagram for explaining a difference between directions of streaks produced due to different rolling directions of the doctor blade.

The rolling direction of the doctor blade 33 is inclined at the angle with respect to the rotating direction of the developing sleeve, and, as shown in FIG. 4 (indicated by "present embodiment" in FIG. 4), fine streaks on the surface are thereby inclined. It is noted that "conventional structure" in FIG. 4 represents a specific surface of the doctor blade 33 shown in FIG. 3A.

Thus, it is possible to prevent the toner from accumulating partially at one positions in the width direction of the doctor blade 33 i.e. in the axial direction of the developing sleeve 31, or from accumulating within fine streaks existing when the rolling direction is set to parallel to the rotating direction of the developing sleeve. This allows the layer thickness in the axial direction of the developing sleeve 31 to be made uniform.

The doctor blade 33 may be made of a following material and may be subjected to a following process.

The material is a microcrystalline SUS material (NAR) manufactured by Sumitomo Metal Industries Ltd., of which rolling direction is set to the angle (θ).

The doctor blade 33 can also be polished, and in this case, a polishing direction is set at the angle (θ) with respect to the rotating direction of the developing sleeve. In addition, depths and pitches of streaks formed by polishing are preferably equivalent to those of the streaks produced by rolling.

Furthermore, it is desirable to specify each width of the streaks to 1 micrometer or less upon rolling to prevent toner from being deposited and condensed.

In the structure as above, by specifying the accelerated agglomeration degree, the circularity, and the volume-average particle size of toner particles, by inclining an extending direction of the streaks, scratches, or irregularities on the doctor blade 33 or by inclining a polishing direction of the doctor blade 33 with respect to the rotating direction of the developing sleeve 31, and further, by specifying the depth and width of the streaks upon rolling, the toner particles can move within the streaks. Thus, toner particles to be deposited within one streak can be eliminated, so that toner particles staying within the streak can be prevented from being condensed and adhering to the streaks.

Particularly, by setting an average circularity of toner particles to 0.95 or more, toner particles with higher circularity more easily move even within a narrow portion and also easily move along the streaks in the rolling direction. Thus, agglomeration due to deposition of the toner particles within the streaks is prevented, and toner adhesion thereto is easily resolved.

In addition, because the developer whose volume-average particle size is 3 micrometers to 9 micrometers is used, it is possible to avoid a phenomenon such that the particle size is small like a developer whose volume-average particle size is 3 micrometers or less and the toner particles are difficult to move. Thus, the toner particles can be prevented from being deposited in the streaks produced due to rolling and from adhering thereto when the particle size is too small. On the other hand, if the particle size is too large, then the effect of grooves produced upon rolling is eliminated.

As explained above, when the developer with the volume-average particle size of 3 micrometers to 9 micrometers is used, its movement along a narrow portion such as the streaks is not interrupted. This allows prevention of condensation due to deposition of toner particles and also prevention of adhesion of toner particles to the streaks or the like.

Furthermore, polymerized toner is used to allow smooth movement thereof within the streaks because of its high circularity and small variation of its particle size. Thus, the toner adhesion is further prevented.

Inventors of the present invention conducted experiments on how toner particles adhere to the doctor blade 33 in the rolling direction using the toner particles under the conditions, and obtained results are as shown in Table 1.

The results in Table 1 are based on the following conditions.

The rolling direction of the doctor blade 33 is divided into 50 degrees to 90 degrees, and polymerized toner as follows is used. That is, the accelerated agglomeration degree of toner is set to 40% or less, the circularity is set to 0.95, and the volume-average particle size is divided into four types (A to D). It is noted that the toner D is a comparative example with respect to results in the present embodiment. The comparative example shows a result of the case in FIG. 3A when the accelerated agglomeration degree of toner is set to 43% and the angle of the rolling direction is set to the angle based on the conventional one.

TABLE 1

| | Toner | | | | | |
|---|---|---|---|---|---|---|
| Experiment No. | Type | Average particle size | Accelerated agglomeration degree | Blade Rolling direction | Result on adhesion | Supplemental |
| 1 | A | 9 μm | 36% | 90° | Little | |
| 2 | | | | 80° | Some | |
| 3 | | | | 50° | A lot | |
| 4 | B | 3 μm | 32% | 90° | Little | |
| 5 | | | | 50° | A lot | |
| 6 | C | 5.2 μm | 13% | 90° | Hardly | |
| 7 | | | | 80° | Some | |
| 8 | | | | 50° | Some | |
| 9 | D | 5.9 μm | 43% | 90° | A lot | Comparative Example |

In Table 1, the toner A has an average particle size of 9 micrometers, so that toner adhesion to the blade is difficult to occur. However, by changing the rolling direction, the effect of the toner A is further increased. Toner B has an average particle size of 3 micrometers, so that toner adhesion to the blade easily occurs. However, by changing the rolling direction, the effect of the toner B is significantly increased. As for the rolling direction in particular, it is found that by setting an upper limit of inclination to 80 degrees, occurrence of toner adhesion is suppressed. Furthermore, when a lower limit thereof was set to less than 5 degrees, it is found that the toner adhesion was recognized although there is no experimental data.

As explained above, the toner D has a high accelerated agglomeration degree, and the fluidity i.e. the movement of the toner is thereby low. Consequently, it is confirmed that even if a pressure of the blade nip portion is set to low, the toner adhesion hardly occurs.

By setting the depth of the streaks in the doctor blade 33 to 1 micrometer or less, toner particles are difficult to enter into the steaks, which allows prevention of toner adhesion caused by condensation of the toner particles due to their deposition thereon.

Furthermore, the developing device 30 is provided in a process cartridge and the process cartridge is provided in the image forming apparatus. Thus, the layer thickness of the toner fed to the developing sleeve is made uniform in the axial direction of the developing sleeve 31, so that an excellent image without white streaks and uneven density in the image can be obtained.

As described above, according to one the present invention, setting of the fluidity of toner and setting of the rolling direction of the layer-thickness control member enable the toner to be difficult to condense, and allow prevention of toner adhesion to the layer-thickness control member by eliminating conditions so that the toner is easily deposited thereon.

Furthermore, according to another aspect of the present invention, to prevent slipping of toner due to the fluidity of the toner, by setting the accelerated agglomeration degree of the toner to 40% or less, the toner adhesion can be prevented even when a pressure between the toner and the blade being the layer-thickness control member is increased allowing for the fluidity.

Moreover, according to still another aspect of the present invention, by setting an angle (θ) of the rolling direction of the blade being the layer-thickness control member to 5 degrees to 80 degrees with respect to the rotating direction of the developer carrier, the toner can be difficult to enter into the streaks on the surface of the layer-thickness control member unlike the case in which the rotating direction is in parallel to the rolling direction. Thus, it is possible to prevent toner deposition to thereby minimize toner adhesion to the layer-thickness control member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device, comprising:

a rotatable developer carrier; and a layer-thickness control member that makes uniform a layer thickness of a developer carried on the developer carrier, wherein an accelerated agglomeration degree of the developer is equal to or less than 40%, the layer-thickness control member includes a blade formed by rolling, and an angle between a rolling direction of the blade and a rotation axis direction of the developer carrier is between 5 degrees and 80 degrees.

2. The developing device according to claim 1, wherein an average circularity of the developer is equal to or more than 0.95.

3. The developing device according to claim 1, wherein a volume-average particle size of the developer is 3 micrometers to 9 micrometers.

4. The developing device according to claim 1, wherein the developer is formed with polymerized toner.

5. The developing device according to claim 1, wherein the layer-thickness control member is formed with a microcrystalline stainless steel material.

6. The developing device according to claim 1, wherein the layer-thickness control member includes streaks formed by polishing equivalent to streaks formed in the rolling direction.

7. The developing device according to claim 1, wherein a width of a streak on the layer-thickness control member in the rolling direction is set to 1 micrometer.

8. The developing device according to claim 1, wherein the rolling forms streaks in the blade at an angle equal to the angle between a rolling direction of the blade and the rotation axis direction of the developer carrier.

9. The developing device according to claim 1, wherein a ratio of an weight-average particle size of developer particles to a number-average particle size of developer particles is 1.00 to 1.40.

10. A process cartridge comprising a developing device including:

a rotatable developer carrier, and a layer-thickness control member that makes uniform a layer thickness of a developer carried on the developer carrier, and an image carrier that carries an electrostatic latent image to be developed by the developing device, wherein an accelerated agglomeration degree of the developer is equal to or less than 40%, the layer-thickness control member includes a blade formed by rolling, and an angle between a rolling direction of the blade and a rotation axis direction of the developer carrier is between 5 degrees and 80 degrees.

11. An image forming apparatus comprising a process cartridge including a developing device and an image carrier, wherein the developing device includes:

a rotatable developer carrier, and a layer-thickness control member that makes uniform a layer thickness of a developer carried on the developer carrier, the image carrier carries an electrostatic latent image to be developed by the developing device, an accelerated agglomeration degree of the developer is equal to or less than 40%, the layer-thickness control member includes a blade formed by rolling, and an angle between a rolling direction of the blade and a rotation axis direction of the developer carrier is between 5 degrees and 80 degrees.

* * * * *